US005439010A

United States Patent [19]

Ross

[11] Patent Number: 5,439,010

[45] Date of Patent: Aug. 8, 1995

[54] FIBROUS BONDED SHEET MATERIAL

[75] Inventor: Derek W. A. Ross, Chirnside Duns, United Kingdom

[73] Assignee: Dexter Speciality Materials Ltd., Edinburgh, United Kingdom

[21] Appl. No.: 171,567

[22] Filed: Dec. 21, 1993

[30] Foreign Application Priority Data

Jan. 6, 1993 [GB] United Kingdom ..... 9300188

[51] Int. Cl.[6] ..... A24B 15/28; B32B 29/06

[52] U.S. Cl. ..... 131/332; 131/365; 131/331; 428/537.5

[58] Field of Search ..... 131/365, 331, 332; 428/355, 537.5; 427/207.1

[56] References Cited

U.S. PATENT DOCUMENTS

| | | | |
|---|---|---|---|
| 2,926,116 | 2/1960 | Keim | 162/164 |
| 2,926,154 | 2/1960 | Keim | 260/29.2 |
| 3,125,552 | 3/1964 | Loshaek et al. | 260/78 |
| 3,608,564 | 9/1971 | Takahashi et al. | 131/332 X |
| 3,705,588 | 12/1972 | Tamol et al. | 131/15 B |
| 4,036,114 | 7/1977 | Luke | 93/1 C |
| 4,218,286 | 8/1980 | Jones et al. | 162/164 R |
| 4,407,994 | 10/1983 | Bankert et al. | 524/107 |
| 4,510,950 | 4/1985 | Keritsis et al. | 131/358 X |
| 4,522,686 | 6/1985 | Dumas | 162/158 |
| 4,607,647 | 8/1986 | Doshley et al. | 131/365 |
| 4,614,546 | 9/1986 | Schröer et al. | 106/213 |
| 4,625,737 | 12/1986 | Keritsis et al. | 131/355 |

FOREIGN PATENT DOCUMENTS

| | | |
|---|---|---|
| 0074544A1 | 3/1983 | European Pat. Off. . |
| 0093321A1 | 9/1983 | European Pat. Off. . |
| 2007435 | 1/1970 | France . |
| 985028 | 3/1965 | United Kingdom . |
| 1261400 | 1/1972 | United Kingdom . |
| 2155314A | 9/1983 | United Kingdom . |

*Primary Examiner*—Daniel R. Zirker
*Attorney, Agent, or Firm*—Chilton, Alix & Van Kirk

[57] ABSTRACT

A fibrous bonded sheet material, suitable for conversion into plug wrap for the filter plug in a filter cigarette, is formed by treating a fibrous base web with a polymeric binder (e.g. polyvinyl alcohol), a wet-strength resin (e.g. a polyamide-polyamine-epichlorohydrin resin) and a ketene dimer (e.g. an alkyl ketene dimer). The wet-strength resin may be wholly or partially replaced with a cross-linking agent (e.g. glyoxal). The resultant sheet material exhibits favourable characteristics of air permeability with resistance to the bleedthrough of adhesives used in the production of wrapped filter plug material.

13 Claims, No Drawings

FIBROUS BONDED SHEET MATERIAL

FIELD OF THE INVENTION

The present invention relates to a fibrous bonded sheet material that is suitable for use as a filter wrap for the filter in a filter cigarette, to a process for the preparation of such fibrous bonded sheet material, and to filter cigarettes containing a filter-wrapper made from such a fibrous bonded sheet material. The invention also relates to a mixture of treating agents, including a binder and a wet-strength resin, suitable for use in the preparation of the fibrous bonded sheet material.

BACKGROUND OF THE INVENTION

The filter plug in a filter cigarette is commonly made from cellulose acetate tow or like material. Because such material tends to have a high bulk surface it is difficult to control the dimensions of a plug made solely of such material; thus, it is conventional to enclose the longitudinal, generally cylindrical, surface of the filter plug with a fibrous bonded sheet material, commonly referred to as "plug wrap". In the manufacture of filter cigarettes, typically a filter rod is produced from continuous filter tow and plug wrap. During this process the continuous rod is cut into a configuration of 6-up or 4-up filter lengths. These are transferred to a cigarette machine where they are further cut into double filter lengths, each being equivalent to two cigarette filters. During cigarette assembly a tobacco rod is applied to each end of the double filter length, tipping paper is then applied to the cut length of filter rod, which is then cut to form the discrete cigarettes.

Owing to legislative and other pressures to reduce the level of tar in cigarette smoke, it is now optional to ventilate filter cigarettes by providing the tipping paper with tiny apertures (also referred to as "pores" or "micropores"), the size and number of which may be varied according to requirements. The air admitted into the filter plug through the apertures in the tipping paper exerts a dilution effect, thereby reducing the concentration of tar in the smoke. Furthermore, this additional air allows the smoker to draw more easily on the cigarette.

In describing this invention the term "air permeability" will be used to describe the ability for air to pass through a material when a pressure differential is applied across the material. It is, however, common parlance to use the term "porosity" where strictly speaking "air permeability" is more correct. Where specific reference to types or grades of paper is made herein then commonly accepted terminology is used, e.g. "high porosity" porous plug wrap paper.

It is conventional to employ a non-porous or low- to medium-porosity paper as the plug wrap in full flavoured medium- to high-tar filtered cigarettes; however, the move to ventilated low tar cigarettes gives rise to a need for a plug wrap material that exhibits a higher permeability to air, which is generally achieved by incorporating into the plug wrap material fibres that are of different dimensions than the usual papermaking fibres. However, the use of higher permeability plug wrap material gives rise to problems in the conversion of the sheet material used for the plug wrap into the finished filter rod.

In the production of the filter rod, a continuous tow of fibres is pulled from a bale, the tow is then spread open, a plasticiser is applied and the tow is then brought into the form of a rod of the required diameter; the tow density (derived from the number of filaments in the tow and the respective tex of each filament) is also controlled, since this largely determines the filtration characteristics of the filter plug. The plug wrap is taken from a narrow bobbin or reel (typically one inch (2.54 cm) in width and containing typically 5000 linear meters), an adhesive is applied as a thin bead along a central line to anchor the cylindrical filter tow, with another, and usually more substantial, bead of adhesive being applied at the edge. The beads of adhesive are typically applied through nozzles, although other application means may be used. The plug wrap material is then folded into a tube enclosing the rod of tow material. The adhesive applied to the plug wrap sheet material in the above process is commonly a hot-melt adhesive, although it may be desirable to use a water-based adhesive, alone or in combination with a hot-melt adhesive, with a view to ensuring a good bond, reducing costs, and reducing the likelihood of plasticiser/adhesive interaction (which may be a concern when there is likely to be a long transit time between manufacture and point of sale).

The resultant tube, filled with the tow material, is passed through a garniture, which is a device having a conduit which brings the tube to the required diameter for the finished filter rod. The garniture is also commonly cooled in order to achieve satisfactory bonding of the hot-melt adhesive despite the rapid throughput. When water-based adhesives are employed, it may be appropriate, instead, to heat the garniture in order to effect bonding.

A problem that arises when using a porous or permeable sheet material for the plug wrap is the increased tendency for the adhesive to pass through the sheet ("bleedthrough"), which may cause a build-up of adhesive in the garniture and, indeed, on other parts of the forming apparatus. A build-up of adhesive in such parts as the garniture rod former and pass tubes may cause such deformities in the rod as creasing or dimpling, which may adversely affect the overall cigarette quality. Furthermore, the build-up of adhesive within the garniture may result in variation in filter-rod diameter. Both the deformities such as indentations and the differentials in rod diameter during cigarette assembly will affect the overall ventilation/dilution characteristics of the finished cigarette. The build-up of adhesive can even be so severe as to cause a blockage or restriction of the sealed rod passage, resulting in machine stoppage. In any case, the problem of adhesive bleedthrough and build-up during filter making can lead to poorer process efficiency in view of the need to interrupt the manufacturing process in order to remove the deposits of adhesive.

Accordingly, there is a need in the art for a fibrous bonded sheet material of high air permeability which nonetheless can meet the demands of high-speed converting units and which is not susceptible to excessive bleedthrough of adhesive (preferably whilst allowing sufficient penetration of the adhesive into the sheet material to ensure a good bond).

It has proved difficult to tackle the problem of the bleedthrough of adhesive by using cross-linking agents in the adhesive in order to speed up the curing rate; the cross-linking agents that could be used would generally not be acceptable in a product that comes into contact with the mouth.

SUMMARY OF THE INVENTION

The present invention now provides a fibrous bonded sheet material that comprises (a) a polymeric binder, (b) a wet-strength resin and/or a cross-linking agent and (c) a ketene dimer.

The present invention also provides an aqueous composition comprising (a) a polymeric binder, (b) a wet-strength resin and/or a cross-linking agent and (c) a ketene dimer.

The present invention further provides a process for the production of a fibrous bonded sheet material that comprises treating a fibrous web with a polymeric binder, with a wet-strength resin and/or a cross-linking agent and with a ketene dimer. Preferably, the process comprises treating the fibrous web with an aqueous composition as defined in the immediately preceding paragraph, followed by drying the treated web.

The present invention also provides a filter cigarette, the filter plug of which is wrapped in a fibrous bonded sheet material according to the present invention.

DESCRIPTION OF EXEMPLARY EMBODIMENTS

The fibrous bonded sheet material according to the present invention comprises a base web that has been treated with a polymeric binder, with a wet-strength resin and/or a cross-linking agent and with a ketene dimer. The base web, which will typically be a wet-laid fibrous web, preferably comprises, and more preferably consists essentially of, cellulosic fibres. These may be selected, for example, from wood-pulp fibres (which commonly have an average fibre length of 0.5 to 3.5 mm); non-wood vegetable fibres, preferably having a fibre-length greater than that of woodpulp fibres; regenerated cellulose fibres, in particular rayon fibres; other suitable fibres for tobacco applications such as cellulose acetate; and mixtures of two or more such fibres. Certain preferred webs are formed of a mixture of wood-pulp fibres and longer non-wood vegetable fibres. Non-wood vegetable fibres include cotton, manila hemp (abaca), sisal, flax, bagasse, esparto and the like. The fibres and (if a mixture is used) their proportions will be selected having regard to the desired air-permeability of the finished sheet product. The use of non-cellulosic fibre, e.g. polyester fibre, in the base web may also come into consideration: thus, for example, it may be envisaged that, with a move towards porous plugwrap constructions of higher air permeability, the inclusion of non-cellulosic fibres, especially of higher denier, may be employed to increase the permeability of the fibrous web.

The fibrous bonded sheet is preferably a lightweight material, having a finished basis weight usually within the range of 10 to 40 g/m$^2$, preferably from 17 to 30 g/m$^2$ and more preferably about 20–22 g/m$^2$. However, sheets having lower basis weights also come into consideration.

Conventionally, air permeability for papers used in the manufacture of cigarettes is measured in either K-value or Coresta units. The K-value classification has been developed by the Filtrona Company and the Coresta unit has been developed by the Coresta organisation (Centre de Cooperation pour les Recherches Scientifiques Relatatives au Tabac). Essentially, Coresta defines the air flow through a paper when a differential pressure of 100 mm WG is applied across the paper. K-value defines the differential pressure which must be applied across a paper to deliver an air flow of 1 liter/-min. The air permeability of the finished material of this invention will typically be in the range of 4000 to 40,000 Coresta units (75K to 1000K); however, higher Coresta values may also come into consideration.

The polymeric binder is employed to give the web the requisite strength, stiffness and, to a certain extent, absorbency characteristics. The preferred polymeric binder is polyvinyl alcohol, although other binders, for example cellulose derivatives (especially cellulose ethers, such as sodium salts of 2-hydroxyethyl, methyl, carboxymethyl or carboxyethyl cellulose), alginates or the like, also come into consideration. The amount of polymeric binder applied to the base web is generally such as to give 0.5% to 10% by weight of polymeric binder relative to the finished dry sheet product. Preferably, the level of polymeric binder is at least 1%, more preferably at least 2%, even more preferably from 3 to 7% and especially about 5%, by weight of the finished dry sheet product.

Polyvinyl alcohol is available in various grades of hydrolysis, which will determine the wet-strength binding ability. Polyvinyl alcohol with low degrees of hydrolysis will be easier to dissolve but will not deliver maximum water resistance to the bonded sheet. In addition, varying degrees of polymerisation are possible and higher degrees of polymerisation will deliver greater bond strength. Polyvinyl alcohol is also available in varying degrees of viscosity and in selecting a particular grade of polyvinyl alcohol, the means for applying the composition containing the polyvinyl alcohol to the base web should be taken into consideration. At present, it is preferred to use a polyvinyl alcohol having a high degree of hydrolysis (preferably, 98.5–100%) and a low viscosity (typically 4–20 centipoise (mPas) for a 4% solution at 20° C.), since this has been found to give rise to good binding and also a rapid take-up during application.

Suitable polyvinyl alcohol binders are available under the trade names "Gohsenol", e.g. Gohsenol NL05, and "Wacker", e.g. Wacker G10/20.

Wet strength resins are chemicals which are used as process aids in order to provide a fibrous sheet with wet strength and hence enable it to retain sufficient wet integrity during further processing where the sheet is wetted. In addition, a wet strength resin will confer wet strength to the sheet in its end-use application. In certain embodiments a wet strength resin may be used as a cross-linking agent with another polymeric binding agent.

The preferred wet-strength resins are the polyamide-epihalohydrin or polyamide-polyamine-epihalohydrin resins, especially those resins wherein the epihalohydrin is epichlorohydrin. Such epichlorohydrin resins are described in, for example, U.S. Pat. No. 2,926,116, U.S. Pat. No. 2,926,154 and U.S. Pat. No. 3,125,552, the disclosure in each of which is incorporated herein by reference. Suitable epichlorohydrin resins are available under the trade name "Kymene" (e.g. Kymene 557H, SLX or LX). However, other wet-strength resins or cross-linking agents come into consideration, for example water-soluble, cationic, thermosetting resins, in particular such epihalohydrin-containing resins and especially such epichlorohydrin-containing resins, as described in U.S. Pat. No. 4,218,286, column 6, lines 4–61 (the disclosure in which U.S. patent is incorporated herein by reference), or for example glyoxal used as a cross-linking agent. The wet-strength resin, cross-linking agent or mixture thereof is preferably applied to the base web to give an amount of the resin of 0.03 to 1.5% by weight, preferably from 0.05 to 0.1% by weight and especially about 0.07% by weight, relative to the finished dry sheet product.

Typical ketene dimers may be conventionally represented by the formula $[R—CH=C=O]_2$ in which each of the R groups (which may be identical or different, and possibly substituted) is a hydrocarbyl radical, preferably of 6–30 carbon atoms. The ketene dimer is preferably an alkyl ketene dimer, typically one wherein each of the alkyl groups (which may be the same or different) has from 8 to 22, e.g. 14–16, carbon atoms, or a mixture thereof. Certain alkyl ketene dimers are discussed in GB-A-2,115,314 and in U.S. Pat. No. 4,407,994 (column 7, lines 22–60), the disclosure in both of which is incorporated herein by reference. Other ketene dimers, e.g. cycloalkyl, aryl (e.g. phenyl), aralkyl (e.g. benzyl) and alkaryl ketene dimers, also come into consideration, e.g. those described in U.S. Pat. No. 4,407,994 (column 7, lines 22–60). Suitable ketene dimers are also described in U.S. Pat. No. 4,614,546 and in EP-A-74,544, the disclosures in which are also incorporated herein by reference.

Suitable alkyl ketene dimers are available commercially as sizing agents. Such dimers are available, for example, in the form of an aqueous emulsion under the trade name "Aquapel" from Messrs. Hercules Limited.

The ketene dimer is preferably applied to the base web so as to give a level of from 0.0001 to 0.10%, e.g. 0.001 to 0.05%, by weight, and usually up to 0.012% by weight, relative to the finished dry sheet product. Preferably, the amount of ketene dimer is from 0.002 to 0.006%, especially about 0.004%, by weight relative to the finished dry sheet product.

It will be appreciated that any or each of the polymeric binder, wet-strength resin (and/or cross-linking agent) and ketene dimer may be composed of a mixture of compounds of the appropriate description.

The treating agents, namely the polymeric binder, wet-strength resin (and/or cross-linking agent) and ketene dimer, are usually applied to the pre-formed web; for example, in the case of a wet-laid web they are generally applied after the wet end of the papermaking process and normally after drying. The treating agents are normally each applied to the base web in the form of an aqueous composition (which expression includes an aqueous solution, an aqueous dispersion, an aqueous emulsion or other aqueous mix). The treating agents may be applied to the web in any sequence and this includes embodiments wherein at least two of the agents are applied simultaneously; preferably, they are applied simultaneously in the form of an aqueous composition containing all of the agents. The concentration of the treating agents in the aqueous composition will be selected according to the chosen method of application. Typically, however, the aqueous composition will contain from 4 to 6% by weight, typically about 5% by weight, of polyvinyl alcohol or other polymeric binder (solids content relative to the total mixture), with the other treating agents in appropriate proportions having regard to the intended level in the dry sheet product (assuming a 100% wet pick-up of the treating agents by the base web). Naturally, the concentration may be varied: for instance, more concentrated mixes come into consideration, e.g. when it is necessary or desirable to reduce the drying time and/or the drying temperature. The treating agents may be applied using a conventional size press, dipper or padder, although it is also possible to apply the treating agents by any other suitable treatment process, for example spraying through nozzles, foam coating or knife coating.

The treating agents may be incorporated into the aqueous composition in any convenient order. However, it is generally preferred first to heat the polyvinyl alcohol (if such is used as the polymeric binder) in the presence of the water or other aqueous medium in order to get it into solution, whereupon the wet-strength resin and the ketene dimer may be added (in either order or simultaneously).

It has been found that the present invention may be applied to the production of fibrous bonded sheet material that is eminently suitable for use as plug wrap in the manufacture of filter cigarettes. By means of the present invention, it is possible to produce plug wrap material which is significantly more resistant to bleedthrough of adhesives used in the manufacture of the filter rod whilst allowing sufficient penetration of the adhesive to ensure that a reliable bond is consistently obtained. Moreover, the present invention can give rise to other advantages. Thus, it is possible to subject a bonded web to a washing and re-drying process with a view to obtaining a better and more uniform presentation (in particular a lack of "cockling" or creasing in the plug wrap sheet) and it has been found that the combination of treating agents in the present invention is retained well, even when the sheet is subjected to the washing and redrying process. Furthermore, it is important, for reasons of economy, to be able to recycle "broke" (waste sheet material obtained in the production of plug wrap), and it has been found that the combination of treating agents used according to this invention permits the recycling of broke using conventional broke-recovery systems, such as digestion with hypochlorite.

It is surprising that the combination of treating agents according to this invention can be used so effectively. Thus, the applicant has found that it is not possible satisfactorily to use polyvinyl alcohol on its own since it tends to get washed out of the sheet material in the washing step referred to above. The applicant has also found that the use of polyvinyl alcohol binder in combination with a cross-linking agent such as glyoxal does not lend itself to the recovery of broke by conventional means. The applicant also found that a combination of polyvinyl alcohol and wet-strength agent is also not fully satisfactory, in that the absorbency of the sheet material is not sufficiently reduced to prevent breakthrough of adhesive. It is particularly surprising that a satisfactory combination of treating agents can be achieved by using a ketene dimer with the polymeric binder, especially polyvinyl alcohol, and a wet-strength resin even when the said dimer is used at a level that is low when compared to the recommended levels for use in the conventional sizing of paper and paperboard products.

Conventional papermaking fillers are preferably not included in the fibrous sheets, given the desirability of achieving good air permeability levels; however, the use of such fillers is not precluded. Also, cationic starches and rosins are preferably not included as additives in the fibrous sheet.

The present invention is illustrated in and by the following examples.

EXAMPLE 1

An aqueous treating composition was prepared as follows (the amounts having been scaled up to an industrial mix-tank level).

220 kg of polyvinyl alcohol (Gohsenol NL05), a granular solid, were added to 2000 liters of cold water with agitation to ensure good dispersion. The mix was heated with steam to 80° C. in order to solubilise the polyvinyl alcohol. The volume of the mixture was then brought to 4000 liters by the addition of cold water and 40 liters (as received aqueous dispersion containing 12.5% by weight active) of polyamide-polyamine-epichlorohydrin resin (Kymene 557H) and then 12 liters of alkyl ketene dimer (Aquapel 360X) were added, the temperature of the mix being maintained at 60° C. during treatment. The Aquapel 360X was an emulsion containing 7.7% by weight of solids.

For the purposes of comparison, a mix was prepared as described above but with the Aquapel 360X being omitted.

In a laboratory-scale test, machine-made, cellulosic fibrous untreated sheets were passed through a size press to apply either the comparison treating agent (test A) or the aqueous composition according to the present invention (test B). In both of these tests the dried treated sheets were passed through a water treatment in a further size press pass. A further test (test C) was carried out by treating the machine made sheets with the aqueous comparison treating agent in a size press, followed by drying and then by a pass through a size press to apply an aqueous solution of Aquapel 360X (at a dry solids content of 0.30% by weight).

The treated sheets were then tested for properties that are of importance in the production of plug wrap material and the results are shown in Table 1 hereinafter. The results were compared with the properties of an untreated control sheet and it will be seen that the treatment according to the present invention gives rise to a marked decrease in absorbency without an adverse effect on the other physical properties. In this comparison the application of the Aquapel 360X was equally effective whether applied as a part of the composite mix or applied separately as a second size press treatment.

EXAMPLE 2

A number of aqueous compositions containing polyvinyl alcohol (Gohsenol NL05), polyamide-polyamine-epichlorohydrin resin (Kymene 557H) and alkyl ketene dimer (Aquapel 360X) were prepared as described in Example 1, except that instead of 12 liters of Aquapel 360X, the following amounts of that ingredient were added, as follows:

Mix D—6 liters Aquapel 360X
Mix E—3 liters Aquapel 360X
Mix F—2.5 liters Aquapel 360X
Mix G—2 liters Aquapel 360X
Mix H—1.5 liters Aquapel 360 X Machine-made cellulosic fibrous untreated sheets were passed through a size press containing one of the above mixes, the sheets were dried and the so-treated sheets were then passed through a further size press containing water. The resultant sheets were dried and tested for various physical properties, the results being given hereinafter in Table 2 (the tests being identified therein by the letters of the mixes used).

In all cases, the absorbency was much lower than the absorbency of the control (cf. Table 1 of Example 1). For use as plug wrap, an absorbency in the region of 20 was considered ideal, since bleedthrough of adhesive in filter rod manufacture is thereby markedly reduced and yet the plug wrap material has sufficient absorbency to permit the adhesive to form a strong bond.

A laboratory-scale experiment was carried out in order to determine suitability of the treated sheets for the reclaiming of broke. 227 ml of cold water and 2.25 ml of sodium hypochlorite were mixed in a beaker and 12.5 grams of cellulosic sheet material treated with mix F, as described above, were added. The beaker was left undisturbed for one hour and then examined. It was found that the sheet material readily disintegrated, demonstrating that the treated sheet material was suitable for the reclaiming of broke.

A further test was carried out in which machine-made cellulosic fibrous untreated sheets were treated with a respective mix from mixes D–H described above. As with the samples described above, the dried, treated sheets were passed through a size press containing water and re-dried. The test was carried out by placing a water bead on each resultant sheet sample which was supported in such a way that no other surface pressures were exerted on the sheet and such that the under surface was unopposed (in a similar manner to unopposed water repellency tests). As a control, the test was also carried out on an untreated sheet and also on a sheet treated in a first stage with a composition similar to that of mix F but from which the polyamide-polyamine-epichlorohydrin resin (Kymene 557H) had been omitted (mix I) and in a second stage with water. The results are shown in Table 3, which follows.

TABLE 3

| Mix | Absorption Time |
|---|---|
| Control (untreated) | 0 |
| D | >20 minutes |
| E | 5 minutes |
| F | 180 seconds |
| G | 120 seconds |
| H | 20 seconds |
| I | 50 seconds |

It was observed that the comparison test (with mix I) gave not only a rapid absorption of the water but also gave rise to a wider area spread of the absorbed water in the sheet.

EXAMPLE 3

This Example relates to trials to scale up the investigations conducted on laboratory treated sheets. In these trials machine-made untreated material was post-treated with various mixes on a full-scale dipper on a continuous basis.

Machine-made untreated cellulosic fibrous base material was treated with mix F as described in Example 2 on the said full-scale dipper and the resultant dried sheet material was tested for various physical properties. For comparison purposes, the furnish was also treated in tests using, respectively, a mix similar to mix F but with the polyamide-polyamine-epichlorohydrin resin (Kymene 557H) and the alkyl ketene dimer omitted (mix J); a mix similar to mix F but with the polyamide-polyamine-epichlorohydrin resin (Kymene 557H) replaced by glyoxal and with the alkyl ketene dimer omitted (mix K); and a mix similar to mix F but with only 10 liters of polyamide-polyamine-epichlorohydrin resin (Kymene 557H) added to the batch and with the alkyl ketene dimer omitted (mix L). A further trial using mix F was assessed on the dipper over an extended period to evaluate the application during continuous running; this trial was designated F-1. A further extended trial was carried out on the dipper involving a single application of mix F to machine-made untreated material having a substantially higher air permeability than that used previously (this test being designated F-2 hereinafter).

In all of these dipper trials described in Example 3 the treated material was dried after treatment with the respective mixes and then passed through a water-only size-press treatment. The pick-up rate for each of these full scale trials was targeted at 3% based on dry mix solids in the final treated sheet.

The results are shown in Table 4 hereinafter (the tests being identified therein by the letters of the mixes used, except where stated otherwise above). It will be seen that the sheets treated according to the present invention (tests F, F-1 and F-2) exhibited a significantly lower absorbency than the comparison samples, whilst retaining acceptable values for the other physical parameters that were tested.

TEST METHODS

The results recorded in Tables 1, 2 and 4 hereinafter were obtained by the following test methods. The tests were performed on samples conditioned to 50%RH and 23° C.; TAPPI method T402om-88.

Tensile strength was tested according to TAPPI method T494om-88; 25 mm width, 25 mm/min extension rate, 125 mm gauge length. Results were converted to Newtons/meter width.

Basis weight was tested on samples of size 20 cm×20 cm.

Tear strength was tested according to TAPPI method T414om-88; Elmendorf internal tear resistance. Results are expressed in millinewtons.

Air permeability was tested using a PPM200 test instrument.

Thickness was tested according to TAPPI method T411om-89; test head area of 200 $mm^2$ at a pressure of 50 kPa.

Smoothness was tested according to BS4420:1990; Bendsten method.

Absorbency was tested by a water-climb method and the results are expressed in mm.

The pick-up of treatment chemicals is in percent by weight.

It will of course be understood that the present invention has been described above purely by way of example and that modifications of detail can be made within the scope of the invention.

TABLE 1

| Test | Finished Product Basis Wt. ($g/m^2$) | Treatment* Pick-up (%) | Tensile MD (N/m) | Tensile CD (N/m) | Tear MD (mN) | Tear CD (mN) | Air Permeability (Coresta units) | Thickness (μm) | Smoothness (mL/min) | Absorbency (mm) |
|---|---|---|---|---|---|---|---|---|---|---|
| A | 23.91 | 3.0 | 2088 | 491 | 360 | 500 | 9501 | 72 | 1400 | 48 |
| B | 23.89 | 2.9 | 2048 | 530 | 420 | 680 | 10027 | 71 | 1400 | 0 |
| C | 24.04 | 3.0 | 1933 | 498 | 400 | 600 | 10180 | 71 | 1400 | 0 |
| Control | 22.06 | — | 1039 | 277 | 380 | 400 | 11095 | 72 | 1400 | 86 |

Note:
*Treatment: % dry treatment chemicals in final bonded sheet
MD = machine direction
CD = cross-machine direction

TABLE 2

| Test | Finished Product Basis Weight ($g/m^2$) | Treatment* Pick-up (%) | Tensile MD (N/m) | Tensile CD (N/m) | Tear MD (mN) | Tear CD (mN) | Air Permeability (Coresta units) | Absorbency (mm) |
|---|---|---|---|---|---|---|---|---|
| D | 24.03 | 2.7 | 2342 | 804 | 320 | 400 | 9687 | 5 |
| E | 23.67 | 2.8 | 2061 | 640 | 360 | 560 | 10606 | 11 |
| F | 23.17 | 2.6 | 2287 | 744 | 400 | 600 | 10088 | 18 |
| G | 23.20 | 2.5 | 2138 | 631 | 420 | 560 | 10504 | 21 |
| H | 23.69 | 2.7 | 2265 | 730 | 400 | 540 | 9715 | 34 |

Note:
*Treatment: % dry treatment chemicals in the final bonded sheet
MD = machine direction
CD = cross-machine direction

TABLE 4

| Test | Finished Product Basis Weight ($g/m^2$) | Treatment* Pick-up (%) | Tensile MD (N/m) | Tensile CD (N/m) | Tear MD (mN) | Tear CD (mN) | Air Permeability (Coresta units) | Absorbency (mm) | Thickness (μm) | Smoothness (mL/min) |
|---|---|---|---|---|---|---|---|---|---|---|
| J | 23.67 | 3.0 | 2371 | 658 | 420 | 500 | 11233 | 59 | 77 | 1600 |
| K | 23.21 | 3.0 | 2401 | 683 | 360 | 400 | 11687 | 64 | 77 | 1650 |
| L | 23.40 | 3.0 | 2442 | 726 | 360 | 460 | 11635 | 48 | 77 | 1700 |
| F | 23.40 | 3.0 | 2099 | 624 | 360 | 500 | 11461 | 21 | 77 | 1600 |
| F-1 | 22.93 | 3.0 | 2076 | 617 | 380 | 420 | 11353 | 18 | 76 | 1600 |

TABLE 4-continued

| Test | Finished Product Basis Weight ($g/m^2$) | Treatment* Pick-up (%) | Tensile MD (N/m) | Tensile CD (N/m) | Tear MD (mN) | Tear CD (mN) | Air Permeability (Coresta units) | Absorbency (mm) | Thickness (μm) | Smoothness (mL/min) |
|---|---|---|---|---|---|---|---|---|---|---|
| F-2 | 23.63 | 3.0 | 2541 | 1077 | 400 | 520 | 21713 | 9 | 86 | 2200 |

Note:
*Treatment: % dry treatment chemicals in the final bonded sheet
MD = machine direction
CD = cross-machine direction

I claim:

1. A fibrous bonded sheet material that comprises (a) a polymeric binder in an amount of from about 0.5 to about 10% by weight, relative to the total dry sheet, (b) a component selected from the group consisting of a wet-strength resin, a cross-linking agent and a mixture thereof, said component being present in an amount of from about 0.03 to about 1.5% by weight, relative to the total dry sheet, and (c) a ketene dimer in an amount of from about 0.0001 to about 0.10% by weight, relative to the total dry sheet, the sheet having an air permeability of at least 4,000 Coresta units.

2. A fibrous bonded sheet material according to claim 1, the fibrous web of which comprises cellulosic fibers.

3. A fibrous bonded sheet material according to claim 1, in which the polymeric binder is polyvinyl alcohol.

4. A fibrous bonded sheet material according to claim 1, in which the polymeric binder is present in an amount of from about 2 to about 7% by weight relative to the total dry sheet.

5. A fibrous bonded sheet material according to claim 1, in which the wet-strength resin is selected from the group consisting of a polyamide-epichlorohydrin resin and a polyamide-polyamine-epichlorohydrin resin.

6. A fibrous bonded sheet material according to claim 1, in which the wet-strength resin is present in an amount of from about 0.05 to about 0.1% by weight relative to the total dry sheet.

7. A fibrous bonded sheet material according to claim 1, in which the ketene dimer is an alkyl ketene dimer.

8. A fibrous bonded sheet material according to claim 1, in which the ketene dimer is present in an amount of from about 0.002 to about 0.012% by weight relative to the total dry sheet.

9. A fibrous bonded sheet material according to claim 2 in which the cellulosic fibers are selected from the group consisting of wood-pulp fibers, non-wood vegetable fibers and mixtures thereof.

10. A fibrous bonded sheet material according to claim 8 in which the ketene dimer is present in an amount of about 0.006% by weight or less relative to the total dry sheet.

11. A fibrous bonded sheet material according to claim 1 in which the polymeric binder is selected from the group consisting of cellulose esters and alginates.

12. A fibrous bonded sheet material according to claim 1 having an air permeability no greater than 4,000 Coresta units.

13. A filter cigarette, in which the filter plug is wrapped in a tube of fibrous bonded sheet material that comprises (a) a polymeric binder in an amount of from about 0.5 to about 10% by weight relative to the total dry sheet, (b) a component selected from the group consisting of a wet-strength resin, a cross-linking agent and a mixture thereof, said component being present in an amount of from about 0.03 to about 1.5% by weight, relative to the total dry sheet, and (c) a ketene dimer in an amount of from about 0.0001 to about 0.10% by weight relative to the total dry sheet, the sheet having an air permeability of at least 4,000 Coresta units.

* * * * *

UNITED STATES PATENT AND TRADEMARK OFFICE

CERTIFICATE OF CORRECTION

PATENT NO. : 5,439,010

DATED : Aug. 8, 1995

INVENTOR(S) : Derek W.A. Ross

It is certified that error appears in the above-indentified patent and that said Letters Patent is hereby corrected as shown below:

Column 12:

Claim 12, line 2, change "4,000" to -- 40,000 --.

Signed and Sealed this

Seventeenth Day of September, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,439,010
DATED : Aug. 8, 1995
INVENTOR(S) : Ross

It is certified that error appears in the above-indentified patent and that said Letters Patent is hereby corrected as shown below:

Col. 12, claim 11, line 3, after "cellulose", change "esters" to --ethers--.

Signed and Sealed this

Tenth Day of February, 1998

*Attest:*

*Attesting Officer*

BRUCE LEHMAN

*Commissioner of Patents and Trademarks*